United States Patent [19]

Schatz et al.

[11] Patent Number: 4,966,819

[45] Date of Patent: Oct. 30, 1990

[54] COVERING FRAME FOR WINDOWS, DOORS, AND THE LIKE

[75] Inventors: Wolfgang Schatz, Weilheim; Helmut Schneider, Grevenbroich, both of Fed. Rep. of Germany

[73] Assignees: Vereinigte Aluminum-Werke AG, Bonn; Braun GMBH & Co., Weilheim, both of Fed. Rep. of Germany

[21] Appl. No.: 296,190

[22] Filed: Jan. 11, 1989

[30] Foreign Application Priority Data

Jan. 13, 1988 [EP] European Pat. Off. ..... 88 100 353.7

[51] Int. Cl.[5] ..... E06B 1/56

[52] U.S. Cl. ..... 428/603; 428/645; 428/650; 428/457; 52/58

[58] Field of Search ..... 428/607, 603, 645, 650, 428/624–626, 458, 461, 462, 457; 52/58, 59, 60, 61, 62

[56] References Cited

U.S. PATENT DOCUMENTS

| | | | |
|---|---|---|---|
| 1,079,035 | 11/1913 | Tebbetts | 428/645 |
| 2,746,136 | 5/1956 | Richaud | 428/645 |
| 2,875,710 | 3/1959 | Bechtold | 52/58 |
| 3,050,410 | 8/1962 | Greene | 428/645 |
| 3,124,427 | 3/1962 | Chomes | 52/61 |
| 3,421,276 | 1/1969 | La Barge | 52/61 |
| 3,497,417 | 2/1970 | Rizzo | 426/645 |
| 4,112,632 | 9/1978 | Simpson | 52/62 |
| 4,685,256 | 8/1987 | Alkjaer | 52/58 |
| 4,750,301 | 6/1988 | Croxford | 52/58 |
| 4,771,179 | 9/1988 | Ijiri et al. | 428/645 |

FOREIGN PATENT DOCUMENTS

| | | | |
|---|---|---|---|
| 53-123360 | 10/1978 | Japan | 428/645 |
| 398318 | 9/1933 | United Kingdom | 428/645 |

OTHER PUBLICATIONS

"LEAD–Flashings, Weatherings and Roofings", Lead Development Association, 18 Adam St., London, W. C. 2, 1958, pp. 1–4, 27.

*Primary Examiner*—John J. Zimmerman
*Attorney, Agent, or Firm*—Darby & Darby

[57] ABSTRACT

A covering frame for roof windows, doors, facade linings or auxiliary materials, the covering including a lead apron forming a water-tight transition. The lead apron has an aluminum layer glued to the top of the lead layer. the aluminum layer protects the lead layer to reduce the likelihood of cracks arising in the lead apron, as well as prevents the leaching of the lead due to weathering. At the same time, the aluminum layer provides for a permanent, decorative appearance of the lead apron. Further protection is available against atmospheric corrosion by applying a coat of paint to the aluminum layer. Preferably, the lead apron is corrugated and pleated together with the aluminum layer.

23 Claims, 2 Drawing Sheets

COVERING FRAME FOR WINDOWS, DOORS, AND THE LIKE

BACKGROUND OF THE INVENTION

The invention relates to a covering for roof windows, doors, and the like and to coverings for roofs and facade linings or auxiliary materials for roofs and walls.

It is known to use a lead apron to achieve water-tight transitions between the covering frame of a roof window and the roof. In practice the lead apron is adapted to the shape of roof tiles by unrolling the material making up the apron from larger rolls onto the frame downwards and then stretching it to the shape of the roof tiles. The material is pressed into a depression of the tiles, which causes a crease in the material. This frequently results in the creation of cracks in the lead apron, through which water can penetrate. The lead apron is then left directly exposed to the weather, which causes the lead in the lead apron to weather over time. As a consequence, the thickness of the lead apron is selected to be greater than is actually necessary. Moreover, a weathered lead apron looks ugly and is perceived as a foreign body on the roof.

SUMMARY OF THE INVENTION

The present invention is directed to a covering for a transition area on an exterior surface of a structure which is sealed by a lead apron and a protective aluminum layer covering the lead apron. This protective aluminum layer prevents the leaching of the lead due to weathering and reduces the possibility that cracks in the lead apron may form. As a consequence, the lead apron maintains a permanent decorative appearance. By avoiding the damaging leaching of lead due to weathering, environmental protection is improved in connection with roof coverings, facades, and auxiliary materials for sealing the transitions in roof, wall, and corner connections.

An elastic connection may be provided between the lead apron and the aluminum layer to make possible a flexible matching to the contour of the roof covering. Corrugating while bringing or gathering together the lead apron and the aluminum layer causes a considerable increase in surface area, which becomes available for matching to the roof covering.

The lead-aluminum apron can be used decoratively and functionally as a transition from a roof and facade covering and as a transition material from exterior surfaces of different structures. Even when the aluminum layer is combined with other materials, the stretching behavior of aluminum has an advantageous affect on the smoothing of the aluminum layer or lead apron due to the increase in surface area. The aluminum may be combined with other materials, such as paper, plastic, alloys and copolymers to form composite materials for the aluminum layer.

Lead-aluminum alloys are a preferred composite material, because they adapt to the expansion behavior of aluminum. Copolymers which are soft and elastic are especially suited for this purpose as well and they can fill up cracks as they appear. Copolymers can thus prevent corrosion of the lead mineral apron underneath and can also flexibly follow the appreciable length changes which arise in the lead apron during temperature fluctuations.

Due to the aluminum layer covering the lead apron, the lead apron is no longer directly exposed to atmospheric corrosion. Erosion of the lead is thus prevented, which results in a considerable improvement in environmental protection.

Further, the lead apron employed can be thinner than has been utilized in the past, because of its combination with another material. Since less lead is required, there is a reduction in the environmentally damaging production of lead. Also, the strength of the composite material of the lead apron and the aluminum layer is increased relative to that of the lead apron alone. At the same time, the total weight of the covering is decreased relative to a covering consisting solely of a lead apron, because weathering away of the lead does not take place.

The lead apron and the aluminum layer are preferably jointly bent at their free ends towards the remainder of the lead apron. This prevents raindrops from reaching the end of the lead apron and improves cohesion of the lead apron and aluminum layer.

A coat of paint, especially a coat of lacquer, can be applied to the aluminum layer to provide additional protection for the aluminum layer against atmospheric corrosion. This coat may be colored to match the color of the roof so that the decorative appearance of the roof covering is improved. The aluminum layer is preferably connected to the lead apron positively fit or non-positively fit, for example by corrugation. The aluminum layer can also be adhesively secured (fastened) to the lead apron by means of glue, adhesive tape, adhesive film, or the like. Such an adhesive is disposed between the aluminum layer and the lead apron.

DETAILED DESCRIPTION OF THE PREFERRED EMBODIMENT

Figure 1:
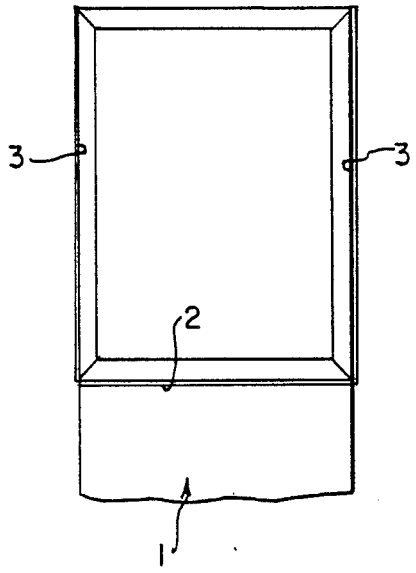
FIG. 1 shows a top view of a first embodiment of a roofing frame and covering in accordance with the present invention.

Turning to FIG. 1, a lead apron 1 connects with a breast plate 2 and with a flashing 3 to provide a weatherproof transition from the roof tiles to the roof window. Such connection may be made by means of a rabbet connection or a clamp connection. The lead apron lies on the roof tiles so that the weight of the lead is sufficient to hold the lead apron on the roof tiles. The lead apron extends essentially horizontally over the roof tiles.

Figure 2:
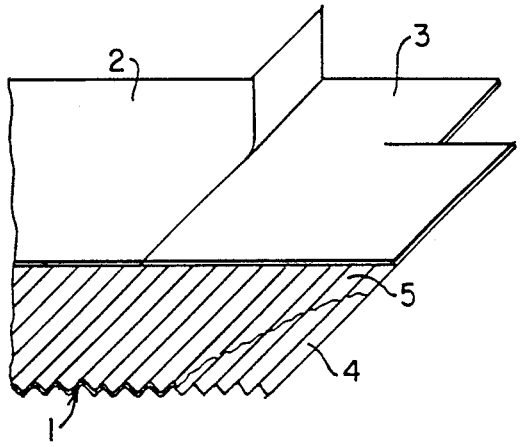
FIG. 2 shows a partially broken prospective view of FIG. 1.
Figure 3:
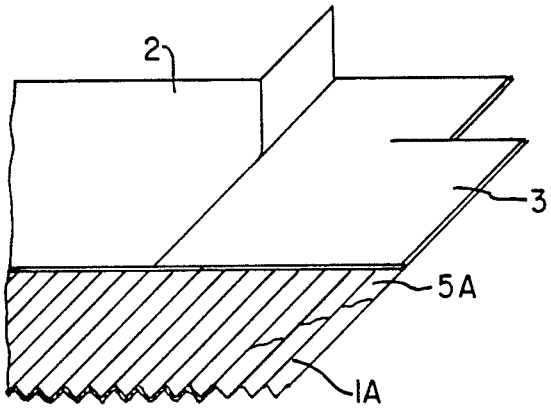
FIG. 3 shows a partially broken prospective view of a second embodiment of the present invention similar to the view of FIG. 2.

As can be seen in FIG. 2, the lead apron 1 comprises an actual lead layer 4 and aluminum foil 5. The aluminum foil 5 is connected to the lead layer 4 and lies on top of it. The aluminum foil 5 may be glued to the lead layer 4. When the entire apron 1 is pleated as is shown in FIG. 2, good cohesion results between the lead layer 4 and the aluminum foil 5 and the lead apron 1 can be matched much more simply and easily to the shapes of the roof tiles.

In a manner similar to the covering of FIGS. 1 and 2 by a sheet metal facing of a roof window, other lead strips can be laid down for roof coverings, facades, and auxiliary materials for ceiling transitions, such as for roof and wall corner connections. For this purpose, a lead strip lA is covered completely or partly by at least one aluminum layer 5A.

Figure 4:
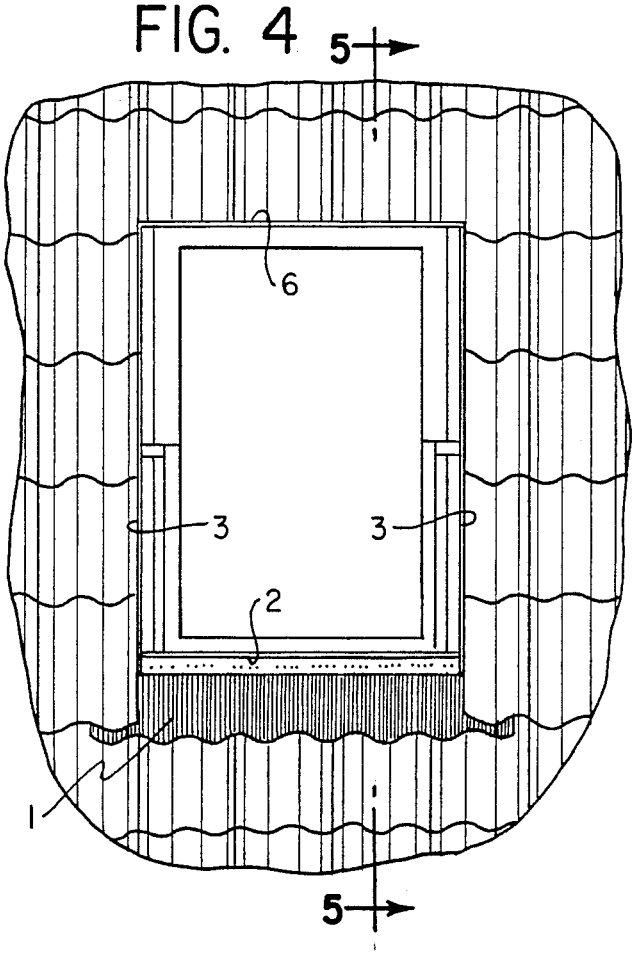
FIG. 4 shows a top view similar to the view of FIG. 1 but with additional detail shown.
Figure 5:
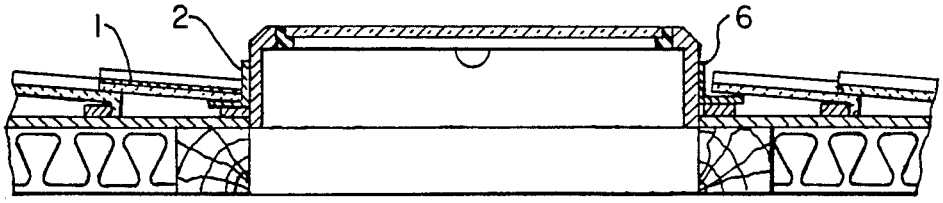
FIG. 5 shows a cross-sectional view taken across section lines 5—5 of FIG. 4.

As can be seen in FIGS. 4 and 5, the lead apron 1 connects with the breast plate 2 and with the two flashings 3. A ridge plate 6 is shown which may be made of a lacquered aluminum sheet, e.g. aluminum magnesium (Al Mg), 1.5 or 0.5 mm thick. The flashing 5 may be made of the same material. The connection between the lead and the aluminum can be attained with a synthetic resin film, e.g. polyethylene/polypropylene, or a synthetic resin glue/paste, e.g. an elastic two-component glue/paste of polyurethane base. Preferably, the breast plate is an alloy of lead and aluminum so as to be compatible with the lead apron and reduce the likelihood of thermal stress problems arising at the connection areas.

The aluminum layer may be formed of a composite material of aluminum combined with paper, plastic, lead alloys or copolymers. Suitable plastics include bitumens, PVC-film or plasticsol. Suitable copolymers include polyethylene, polyethylene-copolymers, polypropylene, and/or polyester film.

The aluminum may be protected against corrosion by applying a coat of lacquer to the aluminum. The coating is produced by a process of coil-coating, that is, a two-layer construction of about 5 μm primer, polyester epoxy base and about 20 μm roof lacquer, polyurethane-polyamide base.

In addition to or instead of a coat of lacquer, plastic film could be applied. The plastic film can be made of PVC, polyacrylic or polyvinylfluoride. The film thickness varies from about 40 μm to about 200 μm. The film is applied by means of an adhesive in the coil-coating process.

Condensate may build up between the lead apron and the roof tiles. The underside of the lead apron should be protected against corrosion of the lead layer. Therefore, the underside of the lead layer is preferably tinned or a layer of aluminum added to prevent this corrosion of the lead layer from taking place.

What is claimed is:

1. A covering for an exterior surface of a structure, comprising:

means for sealing a transition on the exterior surface of the structure, said sealing means including a lead layer;

an aluminum layer covering at least a portion of said lead layer; and a flashing connected to said lead layer.

2. The covering as defined in claim 1, further comprising:

means for flexibly matching to a contour of the exterior surface of the structure, said flexibly matching means including an elastic connection between said lead layer and said aluminum layer.

3. The covering as defined in claim 2, wherein said elastic connection includes a glue of polyurethane base.

4. The covering as defined in claim 1, further comprising:

means for adapting to an expansion behavior of aluminum, said adapting means including aluminum alloys comprising said aluminum layer.

5. The covering as defined in claim 1, further comprising:

means for filling up cracks in said lead layer as said cracks appear so as to prevent corrosion of said lead layer, said filling up means including copolymers comprising said aluminum layer.

6. The covering as defined in claim 1, further comprising:

means for flexibly following length changes during temperature fluctuations arising in said lead layer, said flexibly following means including composite materials comprising said aluminum layer.

7. The covering as defined in claim 1, wherein said aluminum layer covers all of said lead layer for preventing any of said lead layer from being directly exposed to atmospheric corrosion and thereby preventing erosion of said lead layer.

8. The covering as defined in claim 1, wherein said lead layer is corrugated and pleated together with said aluminum layer.

9. The covering as defined in claim 1, further comprising:

aluminum layers on both sides of said lead layer.

10. The covering as defined in claim 1, wherein said aluminum layer is pure aluminum.

11. The covering as defined in claim 1, further comprising:

means for adhesively fixing said lead layer and said aluminum layer together.

12. The covering as defined in claim 11, wherein said adhesively fixing means is one of glue and a material carrying an adhesive.

13. The covering as defined in claim 1, wherein said lead layer is a lead strip for covering roofs and facade facings and auxiliary materials for roofs and walls.

14. The covering as defined in claim 1, further comprising:

a synthetic resin connecting said aluminum layer and said lead layer.

15. The covering as defined in claim 2, wherein said synthetic resin is selected from the group consisting of polyethylene, polypropylene and polyurethane.

16. The covering as defined in claim 1, further comprising:

a breast plate connected to said lead layer, said breast plate being an alloy selected from the group consisting of lead alloys and aluminum alloys.

17. The covering as defined in claim 1, wherein the aluminum layer is aluminum foil.

18. A covering for an exterior surface of a structure, comprising:

means for sealing a transition on the exterior surface of the structure, said sealing means including a lead layer; and an aluminum layer covering at least a portion of said lead layer, said lead layer and said aluminum layer being corrugated together.

19. A covering for an exterior surface of a structure, comprising:

means for sealing a transition on the exterior surface of the structure, said sealing means including a lead layer;

an aluminum layer covering at least a portion of said lead layer; and means for preventing raindrops from reaching free ends of said lead layer and for improving cohesion of said lead layer and said aluminum layer together, said preventing and improving cohesion means including free ends of said lead layer and said aluminum layer being jointly bent toward a remainder of said lead layer.

20. A covering for an exterior surface of a structure, comprising:

means for sealing a transition on the exterior surface of the structure, said sealing means including a lead layer;

an aluminum layer covering at least a portion of said lead layer, and means for protecting said aluminum layer against atmospheric corrosion and including a coating on said aluminum layer, said coating being selected from the group consisting of a coat of paint, a coat of lacquer and a plastic film.

21. A covering for an exterior surface of a structure, comprising:

means for sealing a transition on the exterior surface of the structure, said sealing means including a lead layer; and an aluminum layer covering at least a portion of said lead layer, the lead layer being tinned.

22. A covering for an exterior surface of a structure, comprising:

means for sealing a transition on the exterior surface of the structure, said sealing means including a lead layer;

an aluminum layer covering at least a portion of said lead layer; and means for facilitating cohesion between said lead layer and said aluminum layer and for matching said lead layer to shapes of the exterior of the structure, said facilitating and matching means including said lead layer being entirely pleated.

23. A covering for an exterior surface of a structure, comprising:

means for sealing a transition on the exterior surface of the structure, said sealing means including a lead layer;

an aluminum layer covering at least a portion of said lead layer;

a breast plate; and two flashings, said lead layer connecting with said breast plate and with said flashings.

* * * * *